US005520712A

United States Patent [19]

Bizard

[11] Patent Number: 5,520,712

[45] Date of Patent: May 28, 1996

[54] ABRASIVE CLEANING BALLS AND TO METHODS AND DEVICES FOR MANUFACTURING THEM

[76] Inventor: André Bizard, 47, Boulevard de Beauséjour, 75016 Paris, France

[21] Appl. No.: 262,502

[22] Filed: Jun. 20, 1994

[30] Foreign Application Priority Data

Jun. 22, 1993 [FR] France ..... 93 07548

[51] Int. Cl.[6] ..... B24D 17/00; B24D 18/00

[52] U.S. Cl. ..... 51/299; 51/293; 51/295

[58] Field of Search ..... 51/293, 294, 295, 51/298, 299; 264/142, 143

[56] References Cited

U.S. PATENT DOCUMENTS

| | | | |
|---|---|---|---|
| 3,670,467 | 6/1972 | Walker | 51/298 |
| 3,906,684 | 9/1975 | Marshall et al. | 51/295 |
| 4,263,755 | 4/1981 | Globus | 51/295 |
| 4,581,287 | 4/1986 | Smith et al. | 51/296 |
| 4,927,432 | 5/1990 | Budinger et al. | 51/296 |
| 4,991,362 | 2/1991 | Heyer et al. | 51/295 |
| 5,152,809 | 10/1992 | Mattesky | 51/295 |

FOREIGN PATENT DOCUMENTS 2177232 2/1973 France .

OTHER PUBLICATIONS

Patent Abstract, USP 3,906,684, Sep. 23, 1975, "Abrasive Articles and Their Method of Manufacture".

*Primary Examiner*—Deborah Jones
*Attorney, Agent, or Firm*—Larson and Taylor

[57] ABSTRACT

An abrasive cleaning ball (1) is made of a mass of sponge rubber filled with abrasive grains (2) intimately mixed within the mass. The grains are constituted by short lengths of a wire made of an abrasive material that is polygonal in section, preferably square in section, and coated on its side surfaces with dried adhesive.

11 Claims, 1 Drawing Sheet

ABRASIVE CLEANING BALLS AND TO METHODS AND DEVICES FOR MANUFACTURING THEM

BACKGROUND OF THE INVENTION

It is known that the tubes of heat exchangers or of condensers can be cleaned continuously by causing said tubes to regularly carry a flow of water charged with cleaning balls having a diameter that is slightly greater than the inside diameter of the tubes.

The circulating balls wear, and they are replaced by new balls when their diameter has decreased to a minimum threshold.

The cleaning balls are generally made of sponge rubber having various mineral fillers incorporated therein.

If the fillers are in the form of a powder when they are mixed with the rubber, then the resulting balls are homogeneous.

There also exist so-called "abrasive" balls which are used when the tubes to be cleaned are covered in a particularly adherent deposit.

Such balls are made of sponge rubber like the above "homogeneous" balls, but their surface carries a layer of abrasive particles stuck to the ball by means of a special adhesive.

By way of example, the abrasive particles may be grains of polycarbonate having sharp edges and a size of the order of 1 mm.

A major drawback of balls of the abrasive type is that their abrasive power is of short duration. As soon as the surface layer has worn off, the abrasive power disappears. This generally takes place within a few hours, whereas the lifetime of "homogeneous" balls is several weeks.

Naturally, it would be preferable to use balls containing abrasive grains distributed throughout their volume so as to ensure that they retain their abrasive power even while their diameter is diminishing because of wear.

However, it has not been possible in the past to obtain that result because of the following reasons:

(a) if abrasive grains are incorporated in the rubber during manufacture of a ball, then the grains do not adhere to the rubber: grains at the periphery of the ball become detached very easily so the abrasive power of the ball is quickly lost; and (b) if attempts are made to cover the surface of the grains with adhesive prior to incorporating them in the rubber so as to ensure that they subsequently adhere to the intimate structure of the ball being manufactured, then the grains stick together and form an agglomeration that is impossible to disperse within the rubber during manufacture of a ball.

SUMMARY OF THE INVENTION

An object of the invention is to eliminate the above drawbacks by making it possible to coat part of the surface of abrasive particles with a layer of adhesive without the particles being able to agglomerate together, thus enabling the particles to be dispersed within the rubber during ball manufacture with grains subsequently adhering strongly to the substance from which the ball is made, throughout the bulk of the ball.

Abrasive balls are thus made which retain their abrasive power while they are being worn down.

More precisely, the invention provides abrasive balls of the kind in question which are essentially characterized in that they are constituted by a mass of natural or synthetic sponge rubber filled with abrasive grains intimately mixed in said mass. These grains are constituted by short lengths (segments) of preferably polygonal cross section wire made of an abrasive material and coated on its polygonal surfaces with dried adhesive.

The methods of the invention for manufacturing said balls are essentially characterized by the following sequence of operations: a wire made of the desired abrasive material is initially provided the side surface of the wire is coated with adhesive which loses its stickiness on being dried and which becomes sticky again on being heated to a temperature not greater than the vulcanization temperature of the rubber constituting the ball, the wire coated in this way is dried, the wire dried in this way is cut up into short independent lengths, and said short lengths are intimately mixed with the ingredients for use in forming the ball by conventional operations of molding, heating, and others that are subsequently performed in a manner known per se.

In preferred implementations, use is also made of one or more of the following dispositions:

- the lateral cross-section of the wire is polygonal, and is preferably square;
- the material from which the wire is made is a thermoplastic synthetic substance such as polycarbonate, polyamides, or polyvinyl chloride;
- the diameter or the equivalent diameter of the wire lies in the range 0.4 mm to 2 mm, and preferably in the range 0.7 mm to 1 mm;
- each length is as longas or slightly longer than the diameter or the equivalent diameter of the wire;
- the material constituting the adhesive is an elastomer adhesive that is thermo-reactivatable and vulcanizable, such as polychloroprene having a small percentage of magnesium oxide added thereto;
- the wire is coated by dipping;
- the coated wire is dried by being heated with infrared radiation; and
- the wire is chopped up into lengths or segments by means of a blade of the kind fitted to rotary mowers.

In addition to the above main dispositions, the invention also comprises certain other dispositions which are preferably used simultaneously therewith and which are described in greater detail below.

BRIEF DESCRIPTION OF THE DRAWINGS

There follows a description of a preferred embodiment of the invention given with reference to the accompanying drawing, and naturally given in non-limiting manner.

DESCRIPTION OF THE PREFERRED EMBODIMENTS

Figure 1:
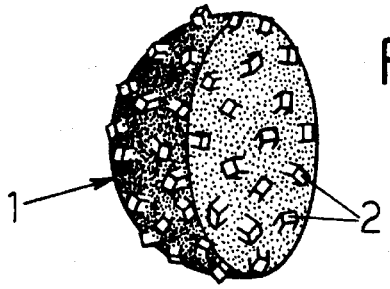
FIG. 1 of the drawing shows an abrasive ball made in accordance with the invention and cut in half.

In general terms, it is proposed to make an abrasive ball 1 constituted by a mass of natural or synthetic sponge rubber having abrasive grains 2 embedded therein.

To this end, a wire 3 is used which is made of the desired abrasive material.

The abrasive material is selected as a function of the characteristics of the tubes to be cleaned.

It must be neither too hard in order to avoid any risk of scratching or damaging the surface of the tube, nor too soft since it must be capable of removing the layer of deposit that covers the inside surface of the tubes.

The material is preferably a synthetic thermoplastic material such as polycarbonate, polyamides, or polyvinyl chloride.

The wire 3 in question may be circular in section.

However, said section is preferably polygonal, in particular square, so that the resulting grains have sharp side edges.

The size (or diameter) of said section depends on the looked-for abrasive power: the bigger a grain, the greater its abrasive power.

The diameter or the equivalent diameter of the wire generally lies in the range 0.4 mm to 2 mm, and preferably lies in the range 0.7 mm to 1 mm when the diameter of the ball to be filled is about 2 cm, and more generally lies in the range 1 cm to 4 cm.

Figure 3:
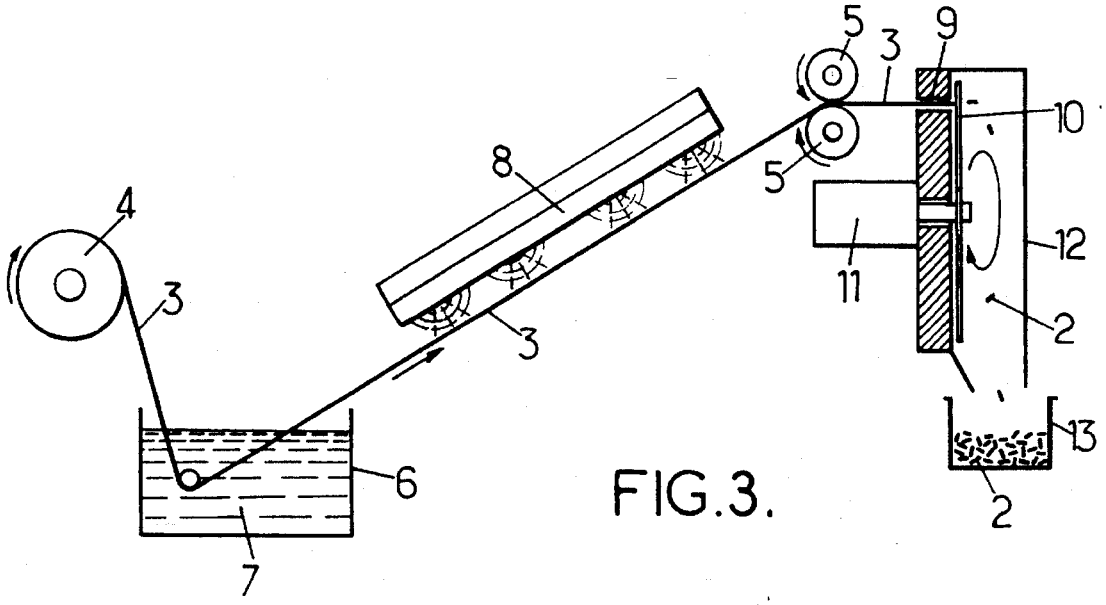
FIG. 3 is a diagram of a method in accordance with the invention for manufacturing the abrasive grains in question.

The wire 3 in question is paid out from a reel 4 (FIG. 3) as the wire 3 is driven by being clamped between two drive rolls 5.

Immediately after leaving the reel 4, the wire 3 is dipped in a tank 6 containing a thermo-reactivatable elastomer adhesive 7.

The characteristics of said adhesive are as follows:

it dries quickly, namely within a few minutes in air, at ambient temperature or at a slightly higher temperature, and on drying it ceases to be sticky;

after said drying, it becomes sticky again merely on being heated to a temperature, e.g. about 80° C., which is greater than its drying temperature while being less than the vulcanization temperature of the rubber; and the adhesive in question is vulcanizable in the same temperature range as the rubber, i.e. in the range 130° C. to 160° C.

An adhesive that satisfies the above characteristics very well is the thermo-reactivatable substance, polychloroprene, plus a small percentage of magnesium oxide which is a substance having the property of causing polychloroprene to vulcanize at the above-indicated temperatures.

After being dipped in the bath of adhesive 7, the wire 3 coated with the adhesive runs past an infrared heating strip 8 that serves to dry the adhesive. The drive rolls 5 are disposed downstream from said strip as shown.

Figure 2:
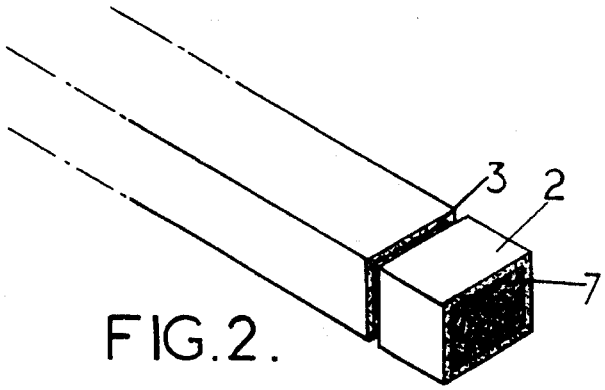
FIG. 2 is a perspective view on a larger scale showing one of the abrasive grains included in the ball.

Immediately after passing between the rolls 5, the wire 3 coated in dried adhesive 7 that is then not sticky passes through a wire guide 9. Immediately on leaving the wire guide the wire 3 is chopped up by means of a rotary chopper 10 of the same kind as the blades fitted to a lawnmower. The rotary blade is driven by an appropriate motor 11. The wire is thus chopped up into short lengths segments that constitute the abrasive grains 2 (see FIG. 2).

The falling grains 2 are guided by a cover 12 and they are collected in a bin 13.

The various or grains 2 are generally as long as or slightly longer than the diameter of the wire 3. Each length is thus generally about 1 mm long.

The grains 2 collected in the bin 13 are in no danger of agglomerating since the film of adhesive that coats a part of each of them is dry and not sticky at this stage.

The grains in question are then mixed while in this state with the other ingredients for making a rubber ball 1.

Said ball is then manufactured using exactly the same technique as is used for conventional homogeneous balls. This technique comprises, in particular, making blanks, i.e. shaped pats each containing an accurate quantity of raw mixture, inserting each pat into a spherically-shaped mold, and then heating it inside the mold to the vulcanization temperature of the mixture.

During vulcanization heating, the layer of adhesive 7 covering each length of abrasive wire is thermo-reactivated, thereby making it sticky again. The adhesive 7 then constitutes a binder between said abrasive length and the matter surrounding it, and during subsequent vulcanization of said binder, genuine bonding takes place between said length or grain 2 and the rubbery material constituting the ball.

This extremely strong bond remains after unmolding and cooling down and as a result an abrasive ball is obtained that contains abrasive grains intimately embedded throughout its mass and regularly distributed therein.

Compared with previously known balls, these balls have the major advantage of retaining abrasive efficiency for a very long time.

While the ball is wearing down because of the large amount of friction to which it is subjected during the cleaning that it performs, said wear gives rise to a progressive reduction in its diameter with a few abrasive grains being torn from its surface, but as the diameter of the ball shrinks, so new abrasive grains that are secured in depth inside the ball take over (become exposed) for the grains that have been torn off.

The cleaning efficiency that results from this special ball structure is therefore considerably increased.

Naturally, and as can already be seen from the above, the invention is not limited in any way to the particular embodiments and implementations that have been described in detail; on the contrary, it extends to all variants, in particular those in which the section of the wire of abrasive material from which the short lengths constituting the abrasive grains are cut has a section other than square, e.g. rectangular, hexagonal, or even circular.

I claim:

1. An abrasive cleaning ball comprising:

a mass of sponge rubber;

a plurality of abrasive grains intimately mixed in said mass of sponge rubber, each said grain being a short longitudinal segment of an elongate wire, being made of an abrasive material, and including a side surface; and an adhesive coated on said side surfaces of said grains which adheres each said grain to surrounding portions of said mass of sponge rubber.

2. An abrasive cleaning ball as claimed in claim 1 wherein said grains have a polygonal cross section.

3. An abrasive cleaning ball as claimed in claim 1 wherein said polygonal cross section of said grains is square.

4. A method of manufacturing an abrasive rubber ball comprising the steps of:

forming an elongate wire of an abrasive material;

coating a side surface of the wire with an adhesive which loses its stickiness when dried and which regains its stickiness when heated to a temperature not greater than a vulcanization temperature of a rubber material forming part of the abrasive ball;

drying the adhesive on the side surface of the wire;

cutting the wire with the dried adhesive thereon into short longitudinal segments; and mixing the longitudinal segments intimately with the rubber material as the rubber material is heated whereby the abrasive rubber ball is formed.

5. A method of manufacturing an abrasive rubber ball as claimed in claim 4 wherein the abrasive material comprises a thermoplastic synthetic substance.

6. A method of manufacturing an abrasive rubber ball as claimed in claim 5 wherein the thermoplastic substance is selected from the group consisting of polycarbonate, polyamide, or polyvinyl chloride.

7. A method of manufacturing an abrasive rubber ball as claimed in claim 4 wherein the elongate wire has a thickness in the range of 0.4 to 2 mm.

8. A method of manufacturing an abrasive rubber ball as claimed in claim 7 wherein the elongate wire has a thickness in the range of 0.7 to 1 mm.

9. A method of manufacturing an abrasive rubber ball as claimed in claim 4 wherein the longitudinal segments are at least as long as a thickness of the wire.

10. A method of manufacturing an abrasive rubber ball as claimed in claim 4 wherein the adhesive which is vulcanizable.

11. A method of manufacturing an abrasive rubber ball as claimed in claim 10 wherein the adhesive is polychloroprene having a small percentage of magnesium oxide added thereto.

* * * * *

UNITED STATES PATENT AND TRADEMARK OFFICE

CERTIFICATE OF CORRECTION

PATENT NO. : 5,520,712

DATED : May 28, 1996

INVENTOR(S) : BIZARD

It is certified that error appears in the above-indentified patent and that said Letters Patent is hereby corrected as shown below:

Cover page, after the name of the inventor, insert:

--[73] Assignee Technos et Compagnie,
Suresnes, France--.

Signed and Sealed this

Eighth Day of April, 1997

*Attest:*

BRUCE LEHMAN

*Attesting Officer*

*Commissioner of Patents and Trademarks*